US005683084A

United States Patent [19]

Dean et al.

[11] Patent Number: 5,683,084

[45] Date of Patent: Nov. 4, 1997

[54] DETECTION DEVICE

[76] Inventors: Thomas William George Dean, Flat 3, 41 Solent Rd., London NW6 1TY; Kenneth Leslie Hawes, 837 Garratt Lane, London SW17 0PG, both of Great Britain

[21] Appl. No.: 418,789

[22] Filed: Apr. 7, 1995

[30] Foreign Application Priority Data

Feb. 7, 1995 [GB] United Kingdom ..... 9502389

[51] Int. Cl.[6] ..... A63F 9/00

[52] U.S. Cl. ..... 273/148 R; 340/567

[58] Field of Search ..... 340/567, 565; 273/148 R

[56] References Cited

U.S. PATENT DOCUMENTS

| | | | |
|---|---|---|---|
| 4,396,193 | 8/1983 | Reinhardt et al. | 273/142 |
| 4,954,813 | 9/1990 | August, Sr. et al. | 340/571 |
| 5,283,422 | 2/1994 | Storch et al. | 235/375 |
| 5,440,292 | 8/1995 | Bedrosian | 340/552 |
| 5,463,595 | 10/1995 | Rodhall et al. | 367/93 |

FOREIGN PATENT DOCUMENTS

| | | |
|---|---|---|
| 2 232 800 | 12/1990 | United Kingdom . |
| 2 255 217 | 10/1992 | United Kingdom . |
| PCT/US92/03997 | 12/1992 | WIPO . |

*Primary Examiner*—William E. Stoll

*Attorney, Agent, or Firm*—Wolf, Greenfield & Sacks, P.C.

[57] ABSTRACT

A casino dolly for use in a roulette game includes sensors, preferably using passive infra red detection, to detect the presence of a hand or movement of chips in an area around the dolly. When the dolly is placed on the area of a winning number on a roulette board it will act to set off an alarm if the sensors detect an attempt to place late bets in the area around the dolly.

7 Claims, 1 Drawing Sheet

DETECTION DEVICE

BACKGROUND OF THE INVENTION

This invention relates to a detection device for use in casinos.

In the game of roulette, once the ball has landed on a number, the dealer places a dolly on the layout and chips associated with the winning number. This prevents punters from placing bets after the ball has dropped on the winning number. However, although it is illegal to place chavals or corners or neighbours (chips physically adjacent to the winning number position on the layout), after the ball has dropped, it is still possible to do this without detection.

An object of the present invention is to provide a means for detecting such illegal placements.

SUMMARY OF THE INVENTION

Accordingly the present invention provides a casino dolly including sensor means arranged to detect the presence or movement of a hand or similar object and/or the movement of chips, within a predetermined distance (for example up to 130 mm) from the dolly, and alarm means responsive to the sensor means and arranged to give an alarm signal in response to such detection, for example for detecting the presence of a hand near the dolly.

The sensor means preferably uses passive infra red detection.

The alarm means may, for example, be visual or audio. Preferably the dolly includes an on/off switch easily operable by the person placing and removing the dolly or the switch is automatic or remotely controlled. The dolly will normally incorporate a battery to operate the sensor and alarm.

DETAILED DESCRIPTION OF ONE EMBODIMENT

Figure 1:
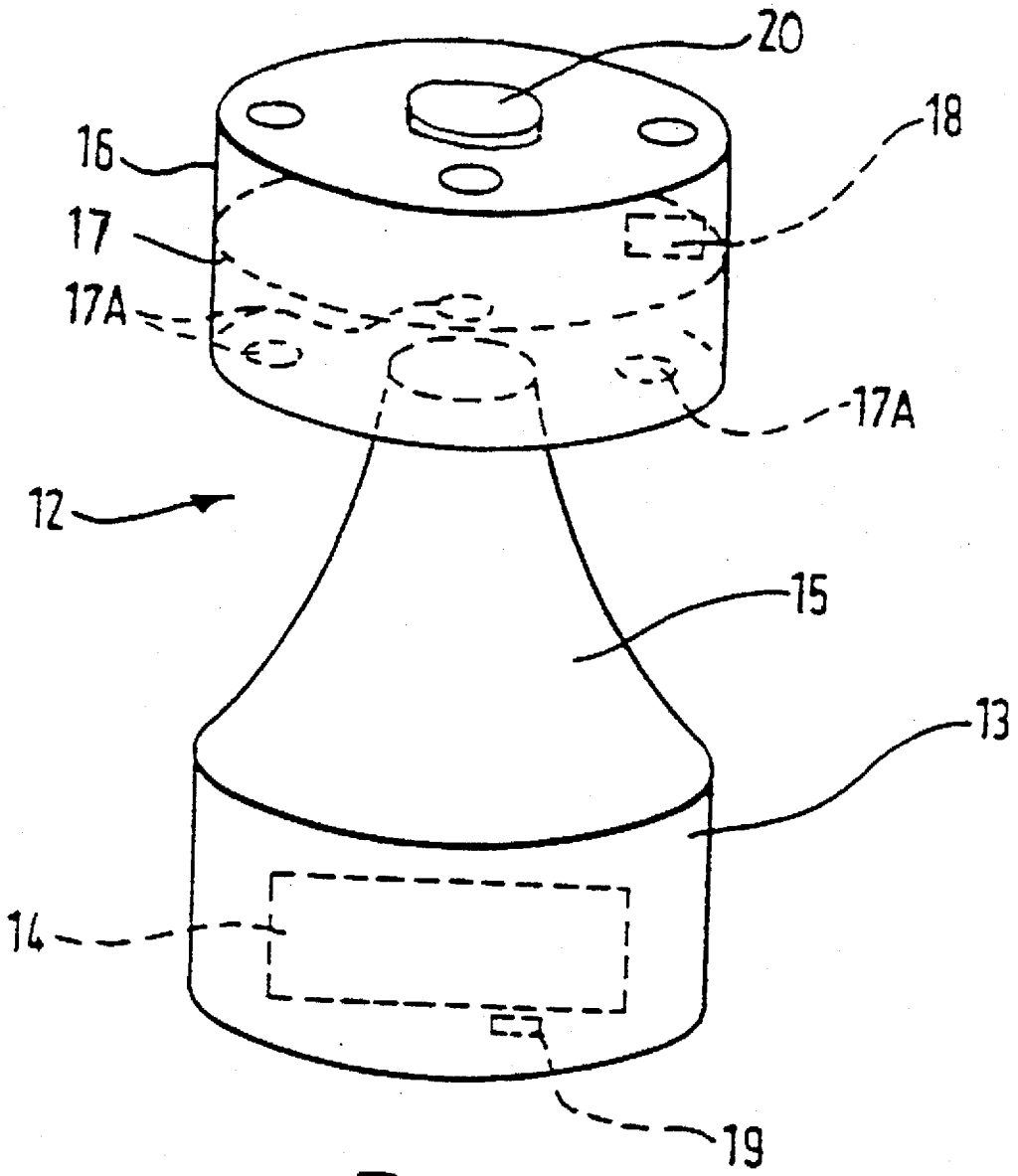
FIG. 1 shows a dolly according to the invention.

One embodiment of dolly, in accordance with the invention, will now be described, by way of example only, with reference to the accompanying diagrammatic drawing.

The dolly 12 incorporates a hollow base portion 13 of about 30 mm diameter housing a battery 14. The base is intended to be placed on the part of the board/layout denoting a winning number together with the chips thereon, as soon as a ball has landed so as to prevent punters from late placing of bets on that position. The size of the winning rectangle is normally 82 mm by 107 mm. The base portion 13 is connected by a hollow tube 15 carrying connecting wires from the battery to an upper portion 16 which acts both as a handle and a housing carrying control means in the form of a printed circuit board 17 and sensors 17A focused on the space all around the base portion 13. The sensors are arranged to detect the presence of a hand or like object within a predetermined distance, such as 130 mm, of the outer walls of the base portion or to detect movement, for example of chips, within that distance. The sensors use passive infra red detection but other technologies could be used such as microwaves, capacitive effects, radio wave absorption, active infra red or optical. This embodiment of dolly has a height of 70 mm but the necessary criteria is that the sensors are positioned at sufficient height (preferably 30 to 60 mm) and arranged so as to cover the predetermined area around the dolly where late bets could win.

The control means in cooperation with the sensors are arranged to operate an audio or visual alarm 18 in response to detection of a substantial object or movement within such space. The lower part includes an on/off switch 19 for disconnecting the sensors from the battery, the switch being positioned to be easily operated, for example, by the thumb of a user holding the dolly so that the alarm will not be operated inadvertently. The switch could be remotely operated or automatic, for example being only switched on when the dolly is upright.

20 is a time delay inhibit switch activated by the dealer's finger. This prevents the dolly from alarming when the dealer is "clearing away" directly after placing the dolly on the winning number. It may be sensitive to the capacitance of the dealer's hand to produce the delay.

The sensors can include any element, whether mechanical, electrical, optical or some combination thereof, that can detect chip or hand motion within a predetermined distance of the dolly. The sensors can, for example, including transceivers that provide signals in any frequency range such as infrared, ultraviolet, microwave, audible, or other.

The control means can include any type of element, whether mechanical, optical or some combination thereof, that controls operation of the alarm in response to motion detection by the sensor. The control means, can, for example, include a microprocessor, analog or digital circuitry, or a combination thereof, that receives a signal from the sensors representing that motion has been detected and, in response, provides an alarm issue control signal to the alarm.

The alarm can include any element that responds to a control signal, whether electrical, optical or other, to provide an alarm signal. The alarm signal itself can be optical, electric or other. The alarm can be an LED (light emitting diode), a loud speaker, or a horn, for examples.

What is claimed is:

1. In a casino dolly of the type including a housing having an upper portion and a base portion, the base portion having upright walls and a base surface for supporting the dolly on a support surface, the improvement comprising:

a sensor mounted in the upper portion and focused downwardly on a space extending for 360° around the walls of the base portion so as to detect movement in an area adjacent and all around the walls of the base portion; and an alarm, operatively coupled to the sensor, that provides an alarm signal upon detection of motion by the sensor.

2. A casino dolly according to claim 1 wherein the alarm is operatively coupled to the sensor by a control means, and wherein the control means activates the alarm in response to detection by the sensor of a movement within the predetermined distance of the dolly.

3. A casino dolly according to claim 2 in which the predetermined distance is up to 130 mm.

4. A casino dolly according to claim 1 in which the sensor is a passive infra red detection means.

5. A casino dolly according to claim 1 wherein the sensors are mounted in the housing at a position 30 to 60 mm above the base surface.

6. A casino dolly according to claim 1 further comprising a disabling means for temporarily disabling the alarm means for a short period of time after the dolly is placed on the support surface.

7. A casino dolly according to claim 1 wherein the support surface is a roulette layout.

* * * * *